US007587779B2

(12) United States Patent
Walz et al.

(10) Patent No.: US 7,587,779 B2
(45) Date of Patent: Sep. 15, 2009

(54) MOBILE FLOOR-CLEANING MACHINE

(75) Inventors: Juergen Walz, Moeckmuehl (DE); Uwe Weller, Allmersbach (DE); Andreas Kral, Remshalden (DE); Dietmar Schneider, Welzheim (DE); Roland Schick, Auenwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/075,113

(22) Filed: Mar. 7, 2008

(65) Prior Publication Data

US 2008/0216259 A1 Sep. 11, 2008

Related U.S. Application Data

(63) Continuation of application No. PCT/EP2006/007194, filed on Jul. 21, 2006.

(30) Foreign Application Priority Data

Sep. 16, 2005 (DE) ..... 10 2005 045 310

(51) Int. Cl.
*A47L 11/283* (2006.01)

(52) U.S. Cl. ..... 15/49.1; 15/50.1; 15/87; 15/180; 451/353

(58) Field of Classification Search ..... 15/49.1, 15/50.1, 87, 98, 180; 451/353
See application file for complete search history.

(56) References Cited

U.S. PATENT DOCUMENTS

| | | | | |
|---|---|---|---|---|
| 2,672,634 | A * | 3/1954 | Burnham | 15/28 |
| 3,401,416 | A * | 9/1968 | Ziegler | 15/49.1 |
| 4,799,282 | A * | 1/1989 | Fischer | 15/98 |
| 5,243,727 | A | 9/1993 | Tanaka et al. | |
| 5,259,085 | A | 11/1993 | Marafante et al. | |
| 5,421,053 | A | 6/1995 | Chodak | |

FOREIGN PATENT DOCUMENTS

| | | |
|---|---|---|
| DE | 930 948 | 7/1955 |
| DE | 86 17 171 | 10/1986 |
| DE | 44 34 520 | 4/1995 |
| DE | 195 22 019 | 12/1996 |
| DE | 201 12 322 | 10/2001 |
| EP | 0 251 987 | 1/1988 |
| EP | 0 487 892 | 6/1992 |
| EP | 1 279 363 | 1/2003 |
| JP | 08 280592 | 10/1996 |
| JP | 2002-65538 | * 3/2002 |
| WO | 98/42245 | 10/1998 |
| WO | 03/053206 | 7/2003 |

OTHER PUBLICATIONS

Tennant Company brochure entitled 5400 Automatic Scrubber, 2004 (4 pages).

* cited by examiner

*Primary Examiner*—Mark Spisich
(74) *Attorney, Agent, or Firm*—Lipsitz & McAllister, LLC

(57) ABSTRACT

The invention relates to a mobile floor-cleaning machine having a rotationally drivable, disk-like cleaning tool which is detachably held on a tool holder, the tool holder being connected to a drive shaft in a rotationally fixed manner. In order to develop the floor-cleaning machine in such a way that the cleaning tool can be easily replaced, the invention proposes that said cleaning tool is adapted to be detachably latched to the tool holder and to be disconnected from the tool holder in the axial direction by means of an unlatching mechanism which is adapted to be operated by the user.

14 Claims, 6 Drawing Sheets

MOBILE FLOOR-CLEANING MACHINE

This application is a continuation of international application number PCT/EP2006/007194 filed on Jul. 21, 2006.

The present disclosure relates to the subject matter disclosed in international application number PCT/EP2006/007194 of Jul. 21, 2006 and German application number 10 2005 045 310.4 of Sep. 16, 2005, which are incorporated herein by reference in their entirety and for all purposes.

BACKGROUND OF THE INVENTION

The invention relates to a mobile floor-cleaning machine having a rotationally drivable, disk-like cleaning tool which is detachably held on a tool holder, the tool holder being connected to a drive shaft in a rotationally fixed manner.

Floor-cleaning machines of this type are used, for example, in the form of so-called scrubber dryers in which the cleaning tool is in the form of a disk brush which slides along the floor and to which cleaning liquid, preferably water, is supplied. Downstream of the floor-cleaning machine, the cleaning liquid which is applied to the floor surface and the dirt which has been detached are picked up from the floor surface by means of a suction foot and returned to a liquid container of the scrubber dryer.

As an alternative, the floor-cleaning machine may be in the form of a polishing machine in which the cleaning tool is in the form of a polishing disk, so that a floor surface can be polished.

The cleaning tool gradually wears down due to contact with the floor surface and therefore has to be replaced by the user from time to time. Replacement may also be necessary in order to employ a cleaning tool which is specially adapted to a particular floor surface.

It should be possible to replace the cleaning tool as far as possible without the use of an additional auxiliary tool. Therefore, mobile floor-cleaning machines are known in which the cleaning tool can be connected to the tool holder by means of a bayonet connection. In this context, European patent specification EP 0 251 987 B1 proposes the use of a locking element by means of which the tool holder can be held such that it cannot rotate, in order to permit release of the cleaning tool which is secured to said tool holder and also simple mounting of the cleaning tool. However, the bayonet connection used in this case requires the floor-cleaning machine to be tilted backward to a great extent in the direction away from the cleaning tool, in order to be able to release the cleaning tool from the tool holder.

It is an object of the present invention to develop a floor-cleaning machine of the type mentioned in the introduction in such a way that the cleaning tool can be more easily replaced.

SUMMARY OF THE INVENTION

According to the invention, this object is achieved in the case of a mobile floor-cleaning machine of this generic type in such a way that the cleaning tool is adapted to be detachably latched to the tool holder and to be disconnected from the tool holder in the axial direction by means of an unlatching mechanism which is adapted to be operated by the user.

The floor-cleaning machine according to the invention is distinguished by a latching connection between the cleaning tool and the tool holder, it being possible to easily release this latching connection by the user operating an unlatching mechanism, so that the cleaning tool can be disconnected from the tool holder in the axial direction, that is to say coaxially with the rotation axis of the drive shaft. In order to establish a connection between the cleaning tool and the tool holder, it is only necessary to place the cleaning tool, which is provided for replacement, on the floor surface and then to position the mobile floor-cleaning machine with the tool holder above the cleaning tool. The floor-cleaning machine can then be lowered, the cleaning tool latching onto the tool holder without auxiliary means. Exchange of a cleaning tool can therefore be effected very easily in the case of the floor-cleaning machine according to the invention.

It is particularly advantageous if the unlatching mechanism is adapted to be operated by means of a foot pedal. The user then only has to operate the foot pedal in order to release the cleaning tool from the tool holder. Said foot pedal may be disposed, for example, to the side of the cleaning tool.

In a preferred embodiment, the unlatching mechanism comprises a pivoting lever which is mounted on the floor-cleaning machine in a pivotable manner, the pivoting lever being adapted to act upon the cleaning tool with a release force which is directed away from the tool holder and is aligned in the axial direction. The pivoting lever may be pivoted in the direction of the floor surface, for example, by means of the foot pedal, so that it bears against the upper face of the cleaning tool and acts downward upon said cleaning tool with a release force in the direction which faces away from the tool holder.

It is advantageous if the pivoting lever is pivotably held on a base plate of the floor-cleaning machine and runs between the base plate and a supporting face of the cleaning tool, which supporting face is disposed at a distance from said base plate. If the pivoting lever is pivoted in the direction of the floor surface, it is supported on the supporting face of the cleaning tool and acts upon said supporting surface with a release force which is directed away from the tool holder, so that the latching connection between the cleaning tool and the tool holder is released without further auxiliary means.

In a preferred embodiment, the pivoting lever is configured as a U-shaped pivoting bow which has two limbs and a cross-piece which connects the limbs to one another, one limb being connected to an operating member, for example a foot pedal, by means of an extension, and the cross-piece being pivotably held on a base plate of the floor-cleaning machine. The U-shaped pivoting bow can laterally surround the tool holder and the drive shaft and act upon the cleaning tool on both sides of the drive shaft with a release force which is directed away from the tool holder. A tilting moment which acts upon the cleaning tool during operation of the pivoting bow is thus avoided.

In a preferred embodiment, the cleaning tool has a carrier part which engages, in a drive position, with the tool holder in a rotationally fixed manner and which is adapted to be moved to a release position, in which it is disengaged from the tool holder, by operation of the unlatching mechanism. The rotationally fixed connection between the carrier part and the tool holder ensures torque transmission from the tool holder to the cleaning tool during operation of the floor-cleaning machine. By operation of the unlatching mechanism, the rotationally fixed connection can be released and the carrier part moved into a release position in which it is disposed at a distance from the tool holder.

In an advantageous embodiment, in order to achieve a latching connection between the cleaning tool and the tool holder, complementary latching elements are disposed on the carrier part and on the tool holder in the form of an annular latching protrusion and a plurality of latching hooks which are adapted to be moved against an elastic restoring force in the radial direction and interact with the latching protrusion. The latching protrusion may be configured as a closed ring, so that it has a very high mechanical load-bearing capacity. The latching hooks which are associated with the latching protrusion can be moved against an elastic restoring force in order to release the latching connection between the cleaning tool and the tool holder. The latching hooks are preferably elastically deformable. To this end, they may have a shank which is aligned, in particular, parallel to the rotation axis of the drive shaft and has a radially oriented latching nose at its free end. The latching nose is adapted to be moved to a position which releases the latching protrusion on account of elastic deformation of the shank.

It is advantageous if the latching protrusion engages beneath the latching hooks in the drive position of the carrier part. For example, provision may be made for the latching hooks, in the drive position of the carrier part, to enter into an annular groove, which annular groove is bounded at the sides by the annular latching protrusion. During operation of the floor-cleaning machine, the cleaning tool is reliably held on the tool holder by means of the latching hooks which enter into the annular groove. If the unlatching mechanism is operated, the latching hooks are moved to a position which releases the annular groove on account of the release force which acts on the cleaning tool, so that the cleaning tool can be released from the tool holder.

The annular latching protrusion is preferably disposed on the tool holder and the latching hooks are preferably disposed on the carrier part.

In order to ensure firstly that the cleaning tool is not unintentionally released from the tool holder during operation of the floor-cleaning machine and secondly that the cleaning tool can be disconnected from the tool holder in a simple manner by operation of the unlatching mechanism, it is advantageous if the latching protrusion has, facing the latching hooks, a sliding face which is inclined at an angle of approximately 20° to approximately 30°, in particular at an angle of from 22° to 28°, preferably at an angle of 25°, in relation to a plane which is oriented perpendicular to the drive shaft. It has been found that unintentional release of the cleaning tool from the tool holder can be prevented by orientation of the sliding face in said angular range, it being ensured however that the user can disconnect the cleaning tool from the tool holder, without an auxiliary tool, by operation of the unlatching mechanism.

As an alternative or in addition, provision may be made for the latching hooks to each have, facing the latching protrusion, a sliding face which is inclined at an angle of approximately 20° to approximately 30°, in particular at an angle of from 22° to 28°, preferably at an angle of 25°, in relation to a plane which is oriented perpendicular to the drive shaft. The provision of a sliding face of this type on the latching hooks prevents, like the provision of a corresponding sliding face on the latching projection, unintentional release of the cleaning tool from the tool holder and nevertheless ensures intentional disconnection of the cleaning tool from the tool holder by means of the unlatching mechanism.

It is advantageous if the carrier part or the tool holder has an annular receiving space into which the tool holder or the carrier part enters by way of a sleeve, the sleeve having the annular latching protrusion on the inside at its end region which enters into the receiving space, and the inside of the receiving space being bounded by an inner ring on which the latching hooks are disposed. The provision of the receiving space into which the sleeve enters can ensure, in a structurally simple manner, that the carrier part is held, in the drive position, immobile on the tool holder transverse to the rotation axis of the drive shaft. The receiving space may be formed, for example, on the carrier part, so that the tool holder can enter into the receiving space by way of a sleeve. However, a reversed configuration may also be used, in which the tool holder has the receiving space and the carrier part enters into the receiving space by way of a corresponding sleeve. The latching hooks are protected against damage by being disposed in the receiving space, this being true in particular when the connection between the tool holder and the carrier part is established, since the latching hooks are first acted upon by a force when the sleeve enters into the receiving space, and therefore an approximately aligned orientation of the tool holder and carrier part is ensured.

In order to ensure torque transmission, it is suitable for the carrier part and the tool holder to be connected to one another, in the drive position, in a rotationally fixed manner by means of a tooth system.

Therefore, provision may be made, for example, for the carrier part to have a plurality of ribs which are disposed at a spacing from one another in the circumferential direction and are oriented in the radial direction and which accommodate between them, preferably with play, a complementarily oriented rib of the tool holder. In this case, it is advantageous if the ribs taper at the end regions thereof which face one another because this simplifies interengagement between the carrier part and the tool holder since the carrier part, if it is not initially optimally aligned in relation to the tool holder, can be automatically oriented by means of the ribs, which slide on one another, to such an extent that the ribs of the carrier part can each enter into the space between two ribs of the tool holder. The carrier part and the cleaning tool can be adapted to unevennesses of the floor, without the tool holder and the drive of the floor-cleaning machine being subjected to a significant mechanical load, by providing play between complementary ribs.

As already mentioned, provision may be made for the carrier part to have an annular receiving space into which the tool holder enters by way of a sleeve. It is suitable here for ribs of the carrier part to protrude into the receiving space in the radial direction and corresponding ribs to project away from the sleeve of the tool holder in the radial direction. As an alternative, a reversed arrangement can also be used in such a way that the tool holder has the annular receiving space into which the carrier part enters by way of a sleeve, ribs of the tool holder protruding into the receiving space in the radial direction and corresponding ribs of the carrier part projecting away from the sleeve in the radial direction. In an embodiment of this type, the tooth system, which can be produced by means of the ribs, between the carrier part and the tool holder is disposed within a receiving space and as a result is protected against contamination and mechanical damage.

In a particularly preferred configuration of the mobile floor-cleaning machine, the carrier part comprises an outer ring and an inner ring which is aligned coaxially with said outer ring, which inner ring and outer ring between them define the receiving space for a sleeve of the tool holder, ribs which are integrally formed on the outer ring protruding into the receiving space and the inner ring being integrally connected to the outer ring by means of a plurality of cross-pieces which run in the radial direction and having a plurality of axially aligned slots, a latching hook which is integrally connected to the inner ring being in each case disposed between two slots. The receiving space is bounded in the radial direction firstly by the outer ring and secondly by the inner ring, and a base of the receiving space is formed by the cross-pieces by means of which the inner ring is integrally connected to the outer ring. A large number of ribs project from the outer ring in a radially inwardly directed manner and latching hooks which face the receiving space are disposed on the inner ring between the slots. A sleeve of the tool holder can enter into the receiving space formed in this way, the sleeve carrying radially oriented ribs on the outside and having a circumferential latching protrusion in the inside, the latching protrusion interacting with the latching hooks disposed on the inner ring. As a result, the carrier part and the tool holder can have a particularly compact configuration with a high mechanical load-bearing capacity. The latching hooks are preferably disposed adjacent to the base of the receiving space. This has the advantage that, when joining the carrier part and the tool holder, the ribs can first be made to engage with one another and therefore a torque for aligning the carrier part and the tool holder relative to one another can be transmitted before the latching hooks are moved. Torque loading of the latching hooks can therefore be avoided.

It is advantageous if the tool holder has a flange which covers the receiving space of the carrier part in its drive position and from which the sleeve projects away in the axial direction.

In an embodiment which can be produced in a particularly cost-effective manner, the carrier part is in the form of a shaped plastic part.

The tool holder is preferably produced from metal, in particular from an aluminum material, for example as a cast aluminum part.

The following description of a preferred embodiment of the invention serves for more detailed explanation in connection with the drawings.

DETAILED DESCRIPTION OF THE INVENTION

Figure 1:
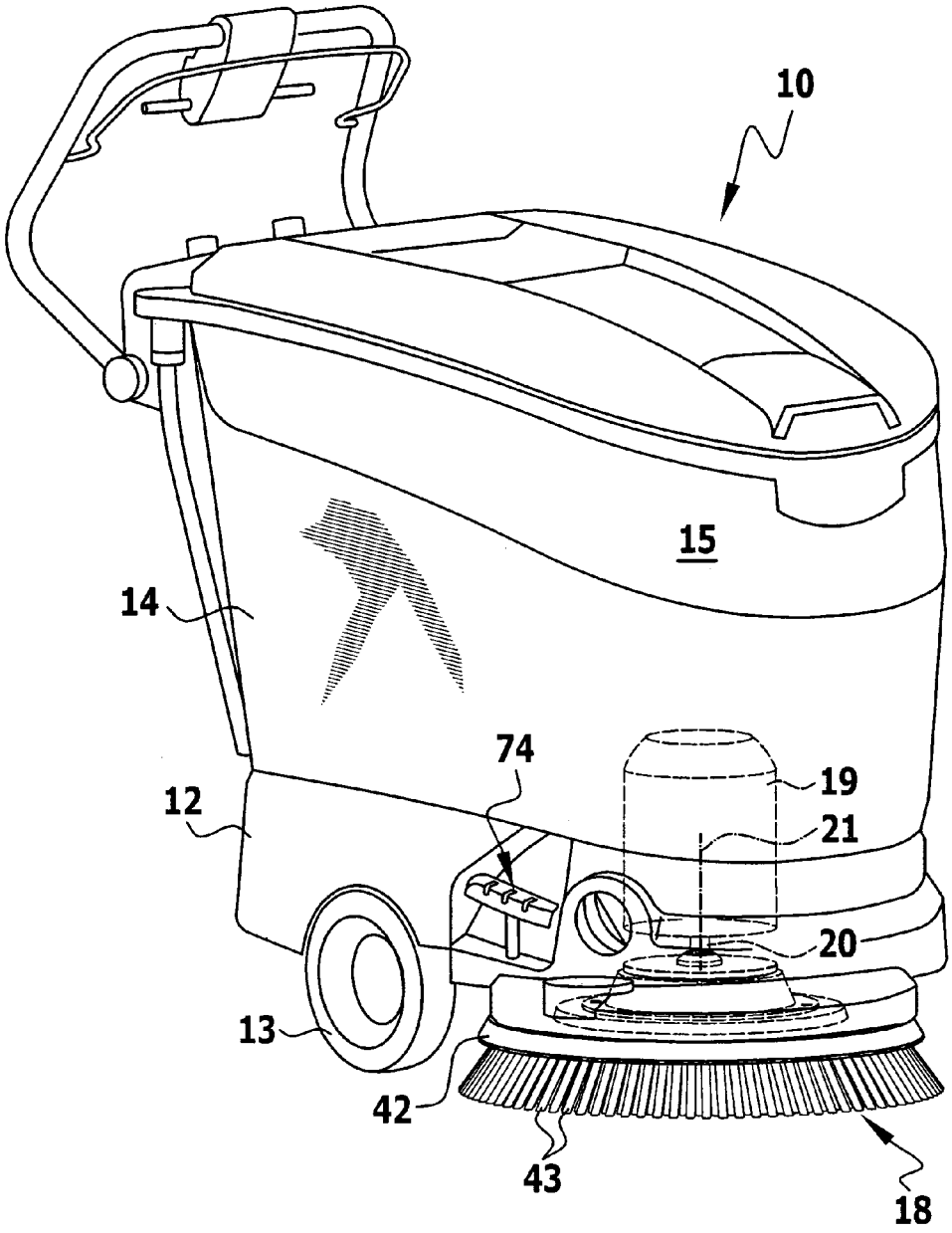
FIG. 1: shows a perspective illustration of a mobile floor-cleaning machine according to the invention with a cleaning tool in the form of a plate brush.

FIG. 1 schematically illustrates a mobile floor-cleaning machine according to the invention in the form of a scrubber dryer 10 with a chassis 12 on which a steerable front wheel is held and two rear wheels are held such that they can rotate about a common rotation axis, only a rear wheel 13 being visible in the drawing. The chassis carries a reservoir 14 for cleaning liquid and a receptacle 15 for soiled cleaning liquid which protrudes into the top of the reservoir 14.

Figure 4:
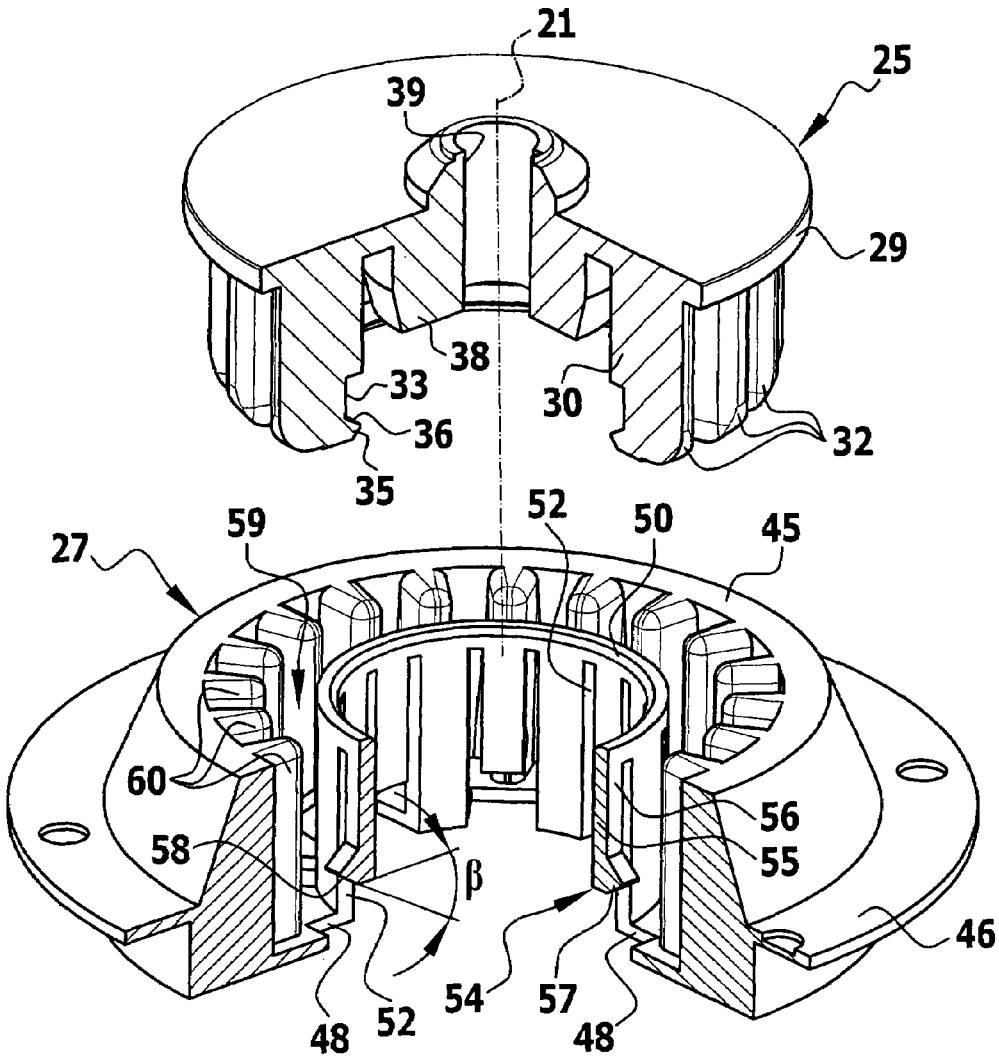
FIG. 4: shows a partially cut-away perspective illustration of the tool holder and a carrier part for the plate brush which is disposed at a distance from said tool holder.
Figure 5:
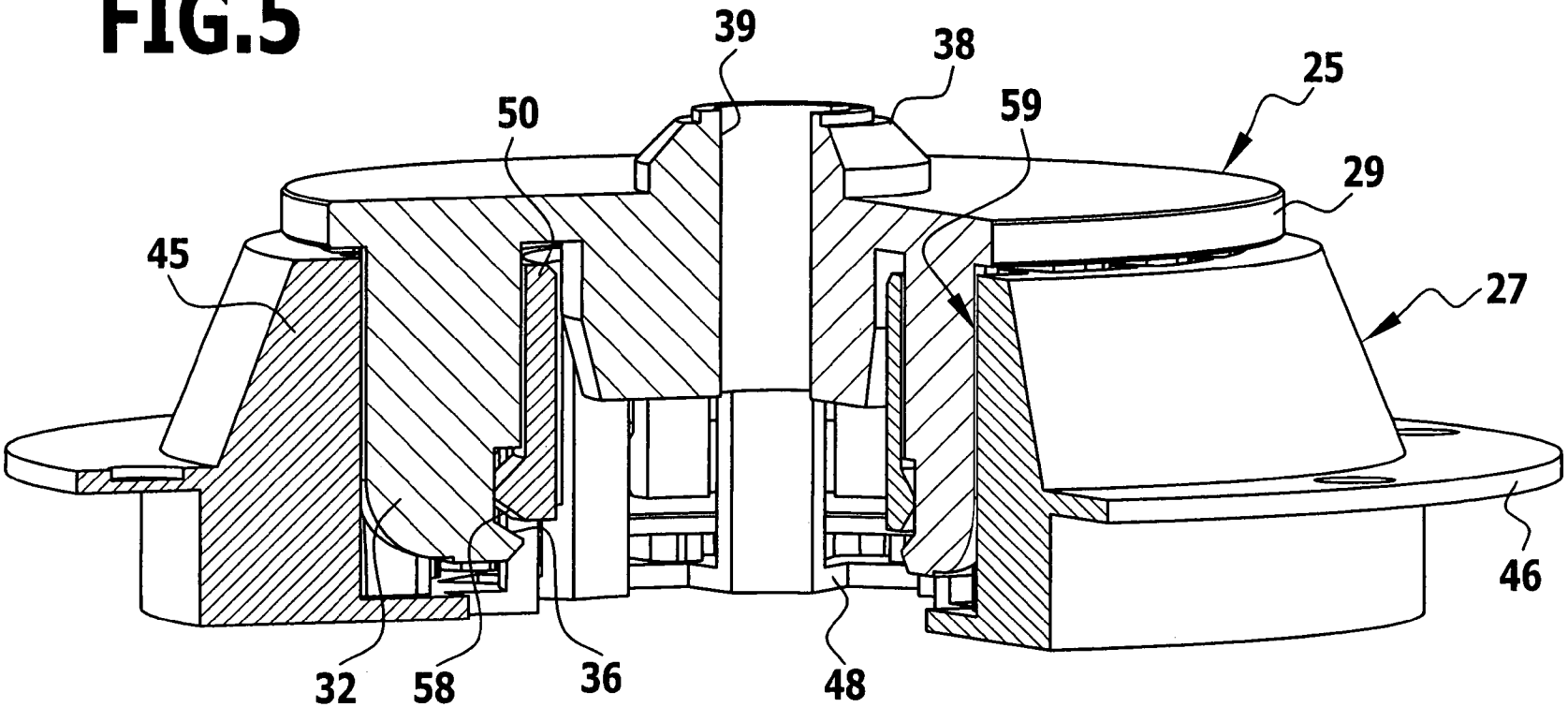
FIG. 5: shows an illustration corresponding to FIG. 4, the carrier part being in engagement with the tool.
Figure 6:
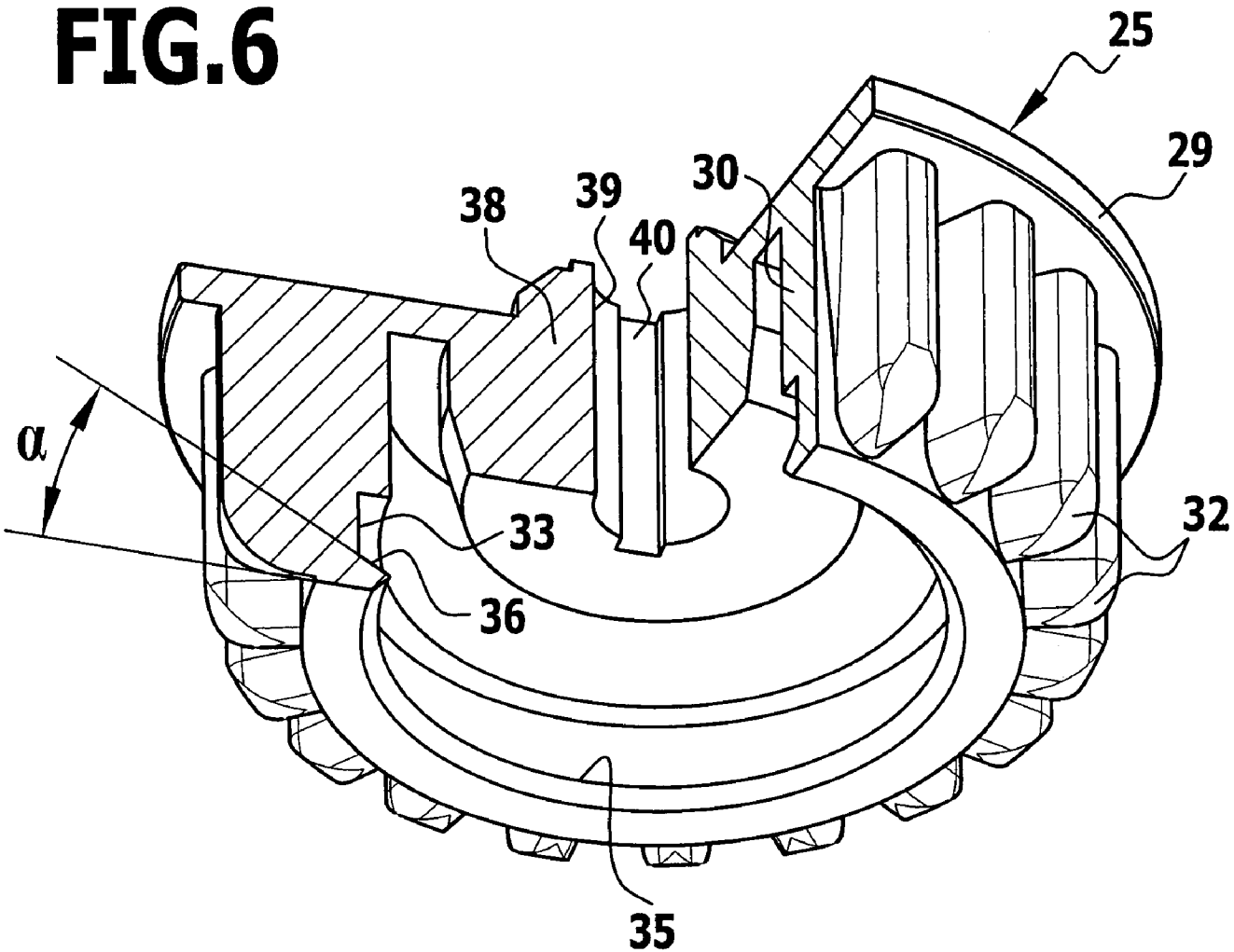
FIG. 6: shows a partially cut-away perspective illustration of the tool holder obliquely from below.

Disposed beneath the chassis 12 is disk-like cleaning tool in the form of a plate brush 18, which brush can be rotationally driven by a drive motor 19 via a drive shaft 20 about a rotation axis 21 of the drive shaft is. As is clear in particular from FIGS. 2 and 3, the drive shaft 20 passes through a base plate 23 of the scrubber dryer 10 and carries, at its free end, a tool holder 25 with which a carrier part 27 of the plate brush 18 can be made to engage. The structure of the tool holder 25 and of the carrier part 27 can be seen in particular in FIGS. 4, 5 and 6.

The tool holder 25 which is positioned beneath the base plate 23 is held at the free end of the drive shaft 20 in a rotationally fixed manner and comprises a support flange 29 from which a sleeve 30 extends coaxially with the rotation axis 21 of the drive shaft 20. On the outside, the sleeve 30 has a multiplicity of ribs 32 which are disposed at a uniform spacing from one another in the circumferential direction, are oriented in a radial direction, start from the support flange 29 and taper in the radial and axial directions. On the inside, that end region of the sleeve 30 which is remote from the support flange 29 has a recess 33 which is adjoined by a latching protrusion 35 running in the circumferential direction and directed away from the support flange 29. The latching protrusion forms a sliding face 36 which is directed toward the support flange 29 and is inclined at an angle $\alpha$ of 25° in relation to a plane oriented perpendicular to the rotation axis 21 of the drive shaft 20.

The tool holder 25 is produced in the form of an integral cast aluminum part. It has, coaxial with the sleeve 30, a hub 38 with a through-hole 39 and a spline groove 40. The through-hole 39 accommodates the free end of the drive shaft which has, on the outside and in a manner which is known and therefore not illustrated in the drawing, a spring which enters into the spline groove 40 in order to produce a rotationally fixed connection between the drive shaft 20 and the tool holder 25.

The plate brush 18 comprises a carrier disk 42 from whose lower face, which is directed away from the base plate 23, a multiplicity of bristles 43 project away in a manner oriented oblique with respect to the rotation axis 21. The carrier part 27 is held on the top of the carrier disk 42 and can be screwed to the carrier disk 42. The carrier part 27 has an outer ring 45 from the outside of which a support flange 46 projects away in the radial direction and which, on the inside, is connected to an inner ring 50 by means of a multiplicity of cross-pieces 48 which are disposed at a uniform spacing from one another in the circumferential direction. The inner ring 50 is aligned coaxially with the outer ring 45 and has, starting from the cross-pieces 48, axially running slots 52 which are disposed at a uniform spacing from one another in the circumferential direction. Two slots 52 accommodate between them, in each case, a latching hook 54 with a shank 55 which starts from that end region 56 of the inner ring 50 which is remote from the cross-pieces 48 and is closed at the top in the circumferential direction, and has a radially outwardly directed latching nose 57 at its free end which faces the cross-pieces 48. The latching noses 57 each have a sliding face 58 which faces the sliding face 36 of the latching protrusion 35. The sliding faces 58 are oriented, so as to correspond with the sliding face 36, at an angle $\beta$ of 25° in relation to a plane which is oriented perpendicular to the rotation axis 21 of the drive shaft 20.

The outer ring 45 and the inner ring 50 define between them a receiving space 59 into which a multiplicity of ribs 60 enter, the ribs being disposed at a uniform spacing from one another in the circumferential direction and being oriented in the radial direction starting from the outer ring 45. The ribs 60 taper in the radial and axial directions.

If the plate brush 18 is connected to the tool holder 25, the sleeve 30 of the tool holder 25 enters into the receiving space 59 in the carrier part 27, two ribs 60 of the carrier part 27 accommodating in each case a rib 32 of the tool holder 25 between them with play. The ribs 32 of the tool holder 25 therefore form, in combination with the ribs 60 of the carrier part 27, a tooth system which is disposed within the receiving space 59 and ensures torque transmission between the tool holder 25 and the carrier part 27.

The latching hooks 54 of the carrier part 27 can be pivoted in the radial direction. If the sleeve 30 is introduced into the receiving space 59, the latching noses 57 of the latching hooks 54 enter into the recess 33 of the tool holder. As a result, the carrier part 27 is fixed to the tool holder 25 in the axial direction. The plate brush 18 can therefore be easily latched to the tool holder 25 with the aid of the carrier part 27.

Figure 2:
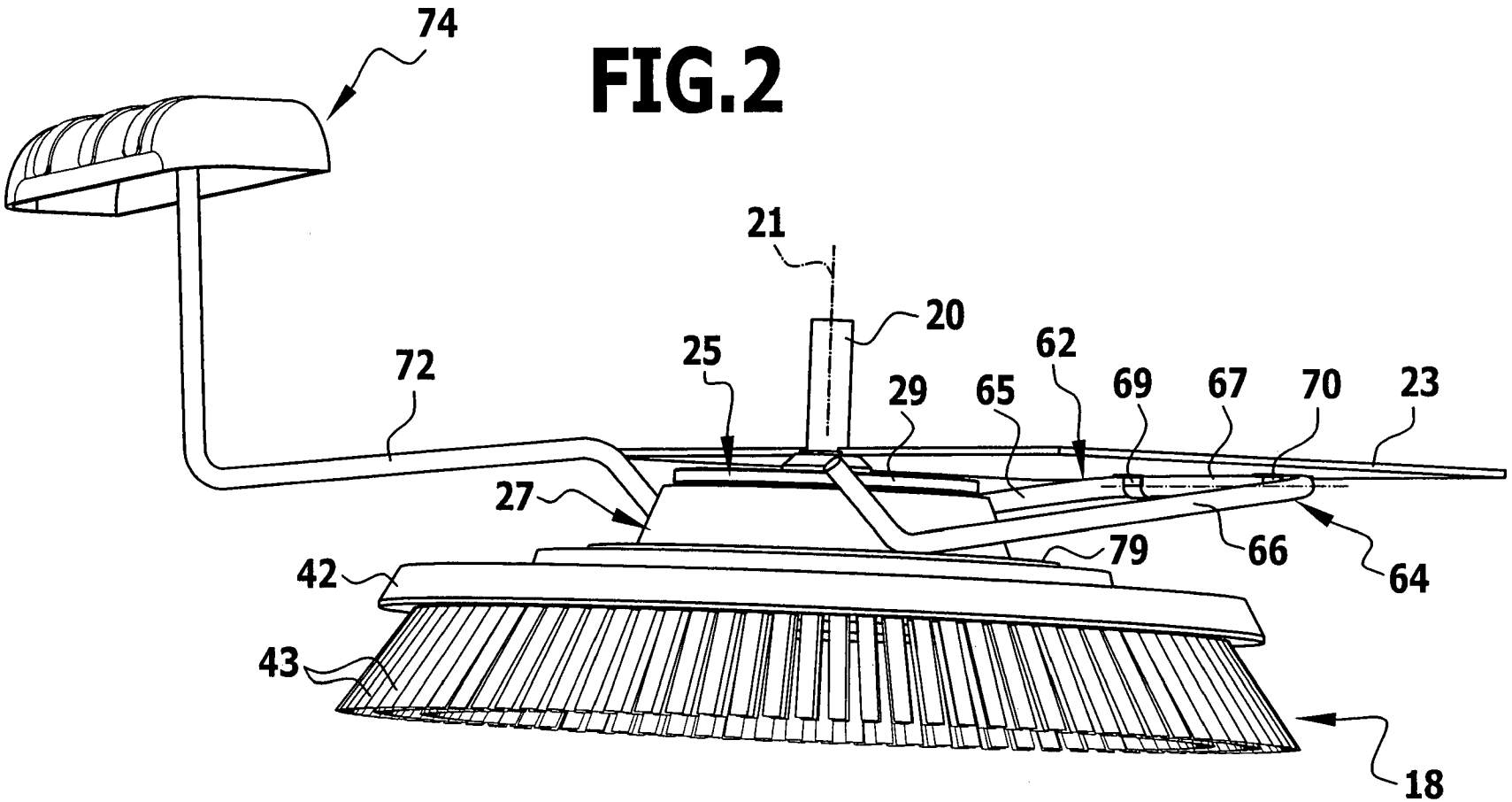
FIG. 2: shows a perspective illustration of the plate brush from FIG. 1 in interaction with an unlatching mechanism, the plate brush being latched to a tool holder.
Figure 3:
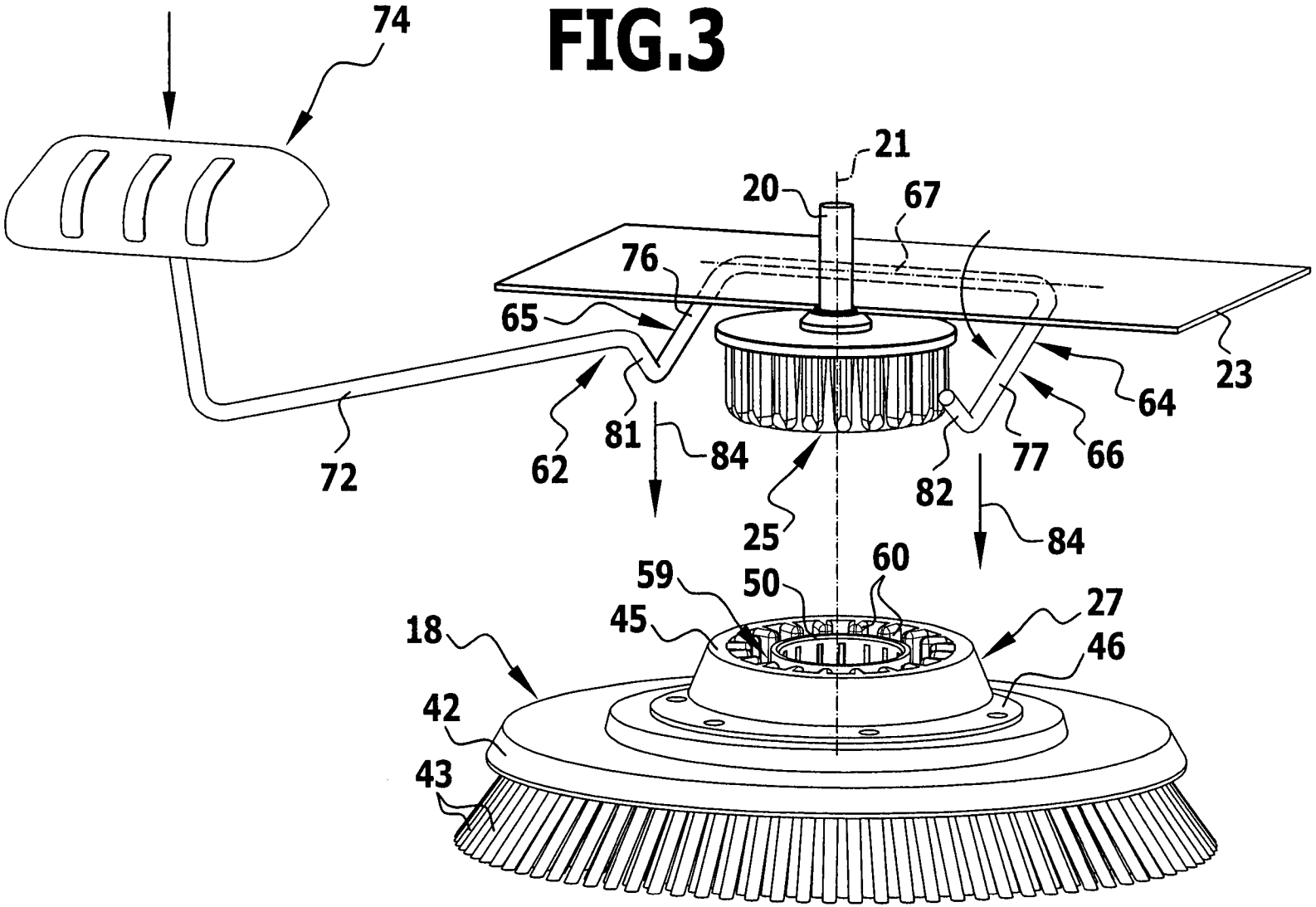
FIG. 3: shows a perspective illustration corresponding to FIG. 2, the plate brush being released from the tool holder.

In order to release the latching connection, the scrubber dryer 10 comprises an unlatching mechanism 62 whose structure is clear, in particular from FIGS. 2 and 3. Said unlatching mechanism has a U-shaped pivoting bow 64 with a first limb 65 and a second limb 66, which limbs are integrally connected to one another by means of a cross-piece 67. The cross-piece 67 is pivotably held on the lower side of the base plate 23 with the aid of mounting elements 69, 70, and the first limb 65 is connected by means of an extension 72 to an operating member in the form of a foot pedal 74 which protrudes laterally out of the chassis 12 in the region between the plate brush 18 and the rear wheel 13 and can be pressed down by the user.

The two limbs 65 and 66 are each angled, a first limb portion 76 or 77, starting from the cross-piece 67, running in the direction of the upper face 79 of the support flange 46 from which a second limb portion 81 or 82 runs in the direction of the base plate 23, so that the pivoting bow 64 bears against the upper face 79 of the support flange 46 in the transition regions between the first limb portions 76, 77 and the second limb portions 81 and 82. This upper face forms a supporting face for the pivoting bow 64 which accommodates the carrier part 67 between its limbs 65 and 66.

In order to release the latching connection between the plate brush 18 and the tool holder 25, the user can push the foot pedal 74 down, so that the pivoting bow 64 is pivoted downward about the longitudinal axis of the cross-piece 67 and, as a result, the carrier part 27 is acted upon by a release force which is symbolized by the arrows 84 in FIG. 3. On account of this application of force, the carrier part 27 is pushed away from the tool holder 25 in the axial direction. This has the result that the sliding faces 58 of the latching hooks 54 slide along on the corresponding sliding faces 36 of the latching protrusion 35 and in the process are pivoted radially inward, so that the latching noses 57 release the recess 33, and the latching connection between the carrier part 27 and the tool holder 25 is released. The plate brush 18 can be completely separated from the tool holder 25 by pivoting the pivoting bow 64 further.

If the plate brush 18 is to be connected to the tool holder 25, it is only necessary for this purpose to place the plate brush 18 on a floor surface and to position the scrubber dryer 10 above the plate brush 18 in such a way that the tool holder 25 is approximately aligned with the carrier part 27. If the scrubber dryer 10 is then lowered, the sleeve 30 of the tool holder 25 enters into the receiving space 59 in the carrier part 27, the plate brush 18 being automatically aligned, on account of the tapering end regions of the ribs 60 and of the ribs 32, in such a way that the ribs 60 are aligned with the intermediate spaces between adjacent ribs 32 of the tool holder 25, and the sleeve 30 can fully enter into the receiving space 59, the latching noses 57 latching into the recess 33.

The latching connection between the tool holder 25 and the plate brush 18 can therefore be both established and released in a simple manner in the scrubber dryer 10 according to the invention.

The invention claimed is:

1. Mobile floor-cleaning machine comprising:

a drive shaft, a tool holder connected to the drive shaft in a rotationally fixed manner, a rotationally drivable, disk-like cleaning tool which is detachably held on the tool holder, the cleaning tool being adapted to be detachably latched to the tool holder, and an unlatching mechanism enabling the cleaning tool to be disconnected from the tool holder in an axial direction wherein:

the cleaning tool has a carrier part which, in a drive position, engages with the tool holder in a rotationally fixed manner and which is adapted to be moved into a release position, in which the carrier part is disengaged from the tool holder, by operation of the unlatching mechanism, complementary latching elements are disposed respectively on the carrier part and on the tool holder in the form of an annular latching protrusion configured as a closed ring and a plurality of latching hooks disposed in a receiving space, each of said latching hooks having a shank which is aligned parallel to a rotation axis of the drive shaft and a radially oriented latching nose at a free end, each said latching nose being adapted to be moved against an elastic restoring force in a radial direction and interact with the closed ring, and the carrier part and the tool holder are connected to one another in the drive position in a rotationally fixed manner by means of a tooth system in which the carrier part has a plurality of ribs which are disposed at a spacing from one another in a circumferential direction and which are oriented in the radial direction and which plurality of ribs accommodate between them, with play, a complementarily formed rib of the tool holder.

2. Mobile floor-cleaning machine according to claim 1, wherein the unlatching mechanism is adapted to be operated by means of a foot pedal.

3. Mobile floor-cleaning machine according to claim 1, wherein the unlatching mechanism comprises a pivoting lever which is mounted on the floor-cleaning machine in a pivotable manner, the pivoting lever being adapted to act upon the cleaning tool with a release force which is directed away from the tool holder and is aligned in the axial direction.

4. Mobile floor-cleaning machine according to claim 3, wherein the pivoting lever is pivotably held on a base plate and runs between the base plate and a supporting face of the cleaning tool, which supporting face is disposed at a distance from said base plate.

5. Mobile floor-cleaning machine according to claim 3, wherein the pivoting lever is configured as a U-shaped pivoting bow which has two limbs and a cross-piece which connects the limbs to one another, one limb being connected to an operating member by means of an extension, and the cross-piece being pivotably held on a base plate of the floor-cleaning machine.

6. Mobile floor-cleaning machine according to claim 1, wherein the closed ring engages beneath the latching hooks in the drive position of the carrier part.

7. Mobile floor-cleaning machine according to claim 1, wherein the closed ring is disposed on the tool holder and the latching hooks are disposed on the carrier part.

8. Mobile floor-cleaning machine according to claim 1, wherein the closed ring has, facing the latching hooks, a sliding face which is inclined at an angle of approximately 20° to approximately 30° in relation to a plane which is oriented perpendicular to the drive shaft.

9. Mobile floor-cleaning machine according to claim 1, wherein the latching hooks each have, facing the closed ring, a sliding face which is inclined at an angle of approximately 20° to approximately 30° in relation to a plane which is oriented perpendicular to the drive shaft.

10. Mobile floor-cleaning machine according to claim 1, wherein the receiving space is annular into which enters a sleeve, the sleeve having the closed ring on the inside at its end region which enters into the receiving space, and the inside of the receiving space being bounded by an inner ring on which the latching hooks are disposed.

11. Mobile floor-cleaning machine according to claim 1, wherein the receiving space is annular and is part of the carrier part into which the tool holder enters by way of a sleeve, ribs of the carrier part protruding into the receiving space in the radial direction and corresponding ribs of the tool holder projecting away from the sleeve in the radial direction.

12. Mobile floor-cleaning machine according to claim 1, wherein the carrier part is in the form of a shaped plastic part.

13. Mobile floor-cleaning machine according to claim 1, wherein the tool holder is produced from metal.

14. Mobile floor-cleaning machine comprising:

a drive shaft, a tool holder connected to the drive shaft in a rotationally fixed manner, a rotationally drivable, disk-like cleaning tool which is detachably held on the tool holder, the cleaning tool being adapted to be detachably latched to the tool holder, and an unlatching mechanism enabling the cleaning tool to be disconnected from the tool holder in an axial direction, wherein:

the cleaning tool has a carrier part which, in a drive position, engages with the tool holder in a rotationally fixed manner and which is adapted to be moved into a release position, in which the carrier part is disengaged from the tool holder, by operation of the unlatching mechanism, the carrier part comprises an outer ring and an inner ring which is aligned coaxially with said outer ring, the inner ring and the outer ring between them define a receiving space for a sleeve of the tool holder, ribs which are integrally formed on the outer ring protruding into the receiving space and the inner ring being integrally connected to the outer ring by means of a plurality of cross-pieces which run in a radial direction, and the inner ring having a plurality of axially aligned slots, a latching hook which is integrally connected to the inner ring being in each case disposed between two slots.

* * * * *